US006533608B2

(12) United States Patent
Sakamoto

(10) Patent No.: US 6,533,608 B2
(45) Date of Patent: Mar. 18, 2003

(54) ELECTRONIC COMPONENT INSTALLATION STRUCTURE

(75) Inventor: Rikio Sakamoto, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 10/000,363

(22) Filed: Dec. 4, 2001

(65) Prior Publication Data

US 2002/0076977 A1 Jun. 20, 2002

(30) Foreign Application Priority Data

Dec. 18, 2000 (JP) ..... 2000-384342

(51) Int. Cl.[7] ..... H01R 13/60

(52) U.S. Cl. ..... 439/541.5; 411/169; 411/973; 411/176

(58) Field of Search ..... 439/541.5, 607, 439/362, 573, 565, 801, 564; 411/182, 508, 509, 169, 973, 173, 176, 177

(56) References Cited

U.S. PATENT DOCUMENTS

| | | | | |
|---|---|---|---|---|
| 3,750,518 A | * | 8/1973 | Rayburn | 85/68 |
| 5,616,052 A | * | 4/1997 | Pan et al. | 439/573 |
| 5,733,142 A | * | 3/1998 | Clark | 439/567 |
| 6,343,957 B1 | * | 2/2002 | Kuo et al. | 439/638 |

* cited by examiner

*Primary Examiner*—Renee Luebke
*Assistant Examiner*—Phuongchi Nguyen
(74) *Attorney, Agent, or Firm*—Sughrue Mion, PLLC

(57) ABSTRACT

An electronic component installation structure according to the present invention includes: a bracket; a female screw with a part thereof built in the bracket; a male screw to be engaged with the female screw; and a prevention element which is provided on the bracket and prevents the female screw from turning when the male screw turns.

8 Claims, 6 Drawing Sheets

ELECTRONIC COMPONENT INSTALLATION STRUCTURE

BACKGROUND OF THE INVENTION

The present invention relates to an electronic component installation structure, and more particularly to an electronic component installation structure that has screws built in a bracket.

Conventionally, there has been an electronic component installation structure that uses rivet screws and hexagon head screws to install electronic components on a bracket.

Referring to FIG. 7, such a conventional electronic component installation structure includes a rivet screw 100, a hexagon head screw 200, a bracket 300, a plastic mold 400, and an electronic component 500. The rivet screw 100 is built in the bracket 300. The rivet screw 100 has a hole therein with its inside threaded. The hexagon head screw 200 is engaged with the rivet screw 100. An operator who installs an electronic component applies torque to the hexagon head screw. This torque causes the hexagon head screw to be engaged with the rivet screw.

To check that the hexagon head screw has been fully engaged with the rivet screw, the operator expects either to have a feeling that the hexagon head screw has been tightened or to realize that the hexagon head screw does not turn any more. However, with the conventional electronic component installation structure described above, when the operator keeps on applying torque while expecting to have a feeling that the hexagon head screw has been tightened or that it does not turn any more even after the hexagon head screw has already been fully engaged with the rivet screws, the applied torque, which is transmitted from the hexagon head screw to the rivet screw, causes the rivet screw itself to turn with the hexagon head screw. As a result, the operator who does not have a feeling that the screw has been tightened keeps on turning the hexagon head screw. Or, assuming that the hexagon head screw has been fully engaged with the rivet screw, the operator stops applying torque to the hexagon head screw even when the hexagon head screw has not yet been fully engaged with the rivet screw. For this reason, the electronic component is not installed properly.

SUMMARY OF THE INVENTION

It is an object of the present invention to provide an electronic component installation structure that prevents a rivet screw from being turned by the torque applied to a hexagon head screw.

It is another object of the present invention to provide an electronic component installation structure that allows an operator to feel that a hexagon head screw has been tightened or to realize that a hexagon head screw has been fully engaged with a rivet screw.

According to one aspect of the present invention, an electronic component installation structure is provided which includes: a bracket; a female screw with a part thereof built in the bracket; a male screw to be engaged with the female screw; and a prevention element which is provided on the bracket and prevents the female screw from turning when the male screw turns.

BRIEF DESCRIPTION OF THE DRAWINGS

Other features and advantages of the invention will be made more apparent by the following detailed description and the accompanying drawings, wherein.

In the drawings, the same reference numerals represent the same structural elements.

DETAILED DESCRIPTION OF THE PREFERRED EMBODIMENTS

A first embodiment of the present invention will be described in detail below.

Figure 1:
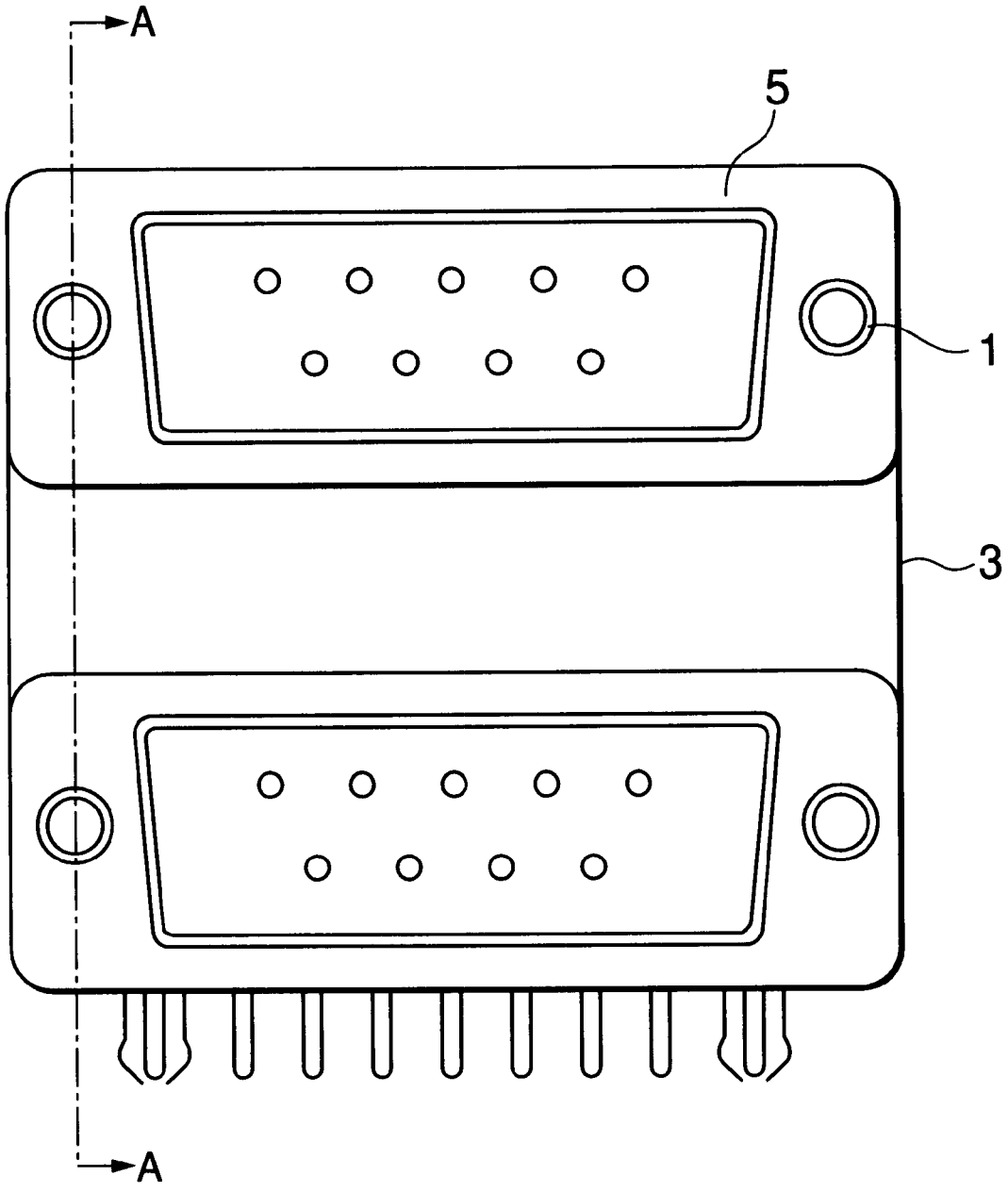
FIG. 1 is a front view of an electronic component installation structure according to the present invention before a hexagon head screw is not yet inserted.
Figure 2:
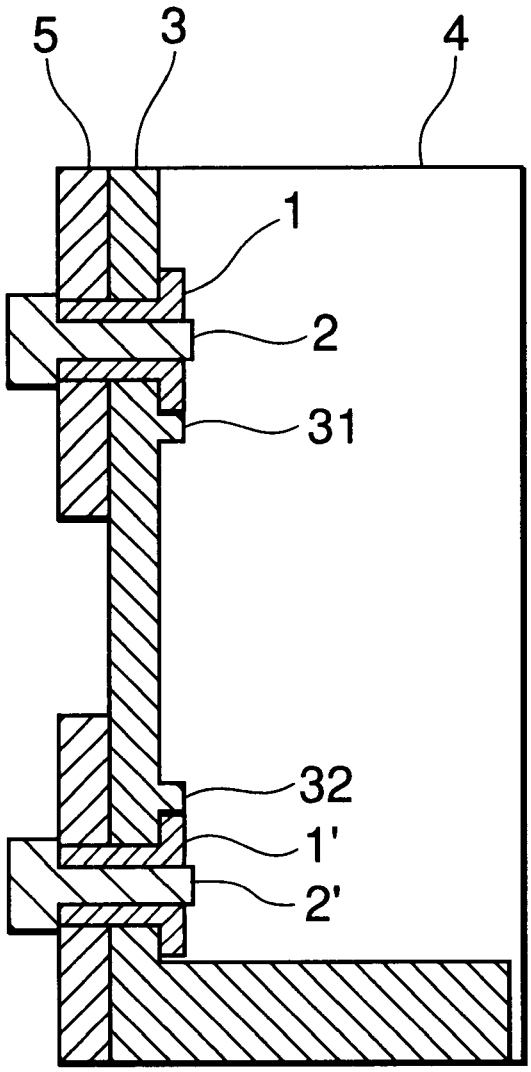
FIG. 2 is a sectional view, taken along line A—A, of the electronic component installation structure according to the present invention.
Figure 3:
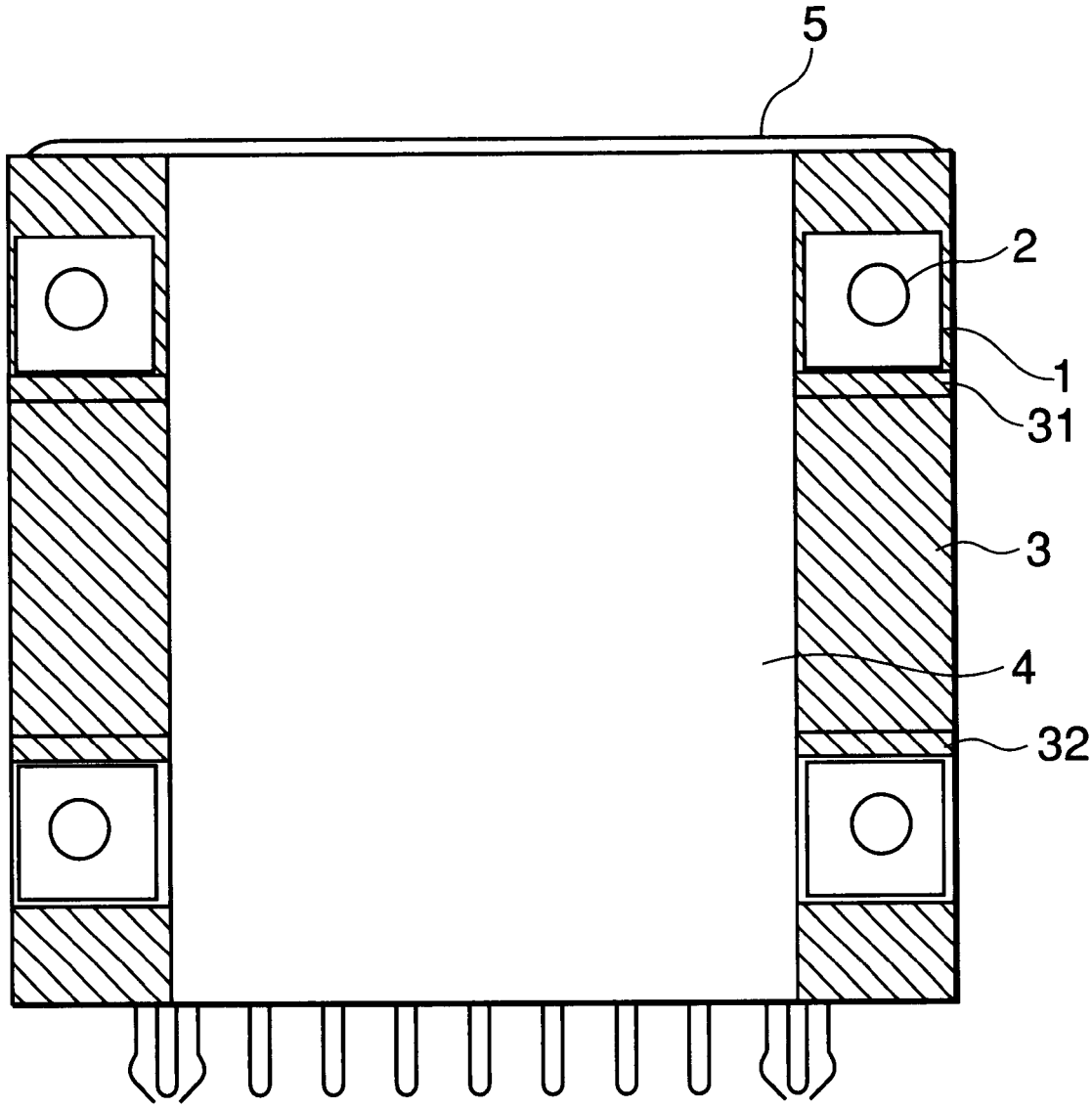
FIG. 3 is a rear view of the electronic component installation structure according to the present invention.

Referring to FIGS. 1, 2 and 3, an electronic component installation structure according to the present invention includes rivet screws 1 and 1', hexagon head screws 2 and 2', a bracket 3, a plastic mold 4, and an electronic component. In this embodiment, the electronic component is a connector 5. The rivet screw 1 has its part built in the bracket 3. The hexagon head screw 2 is engaged with the rivet screw 1. The rivet screw 1 and the hexagon head screw 2 together fasten the connector 5 on the plastic mold 4.

Figure 4:
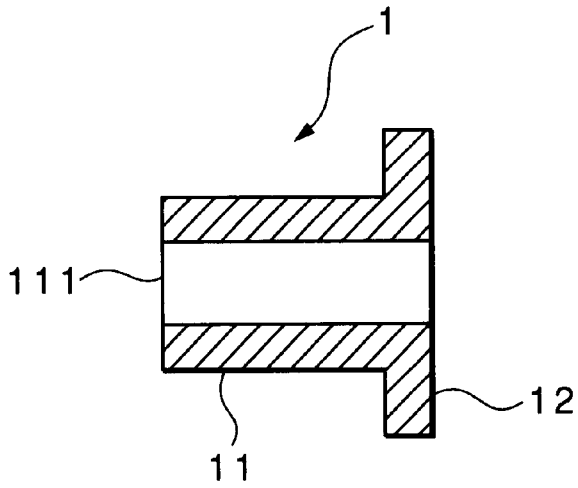
FIG. 4 is a diagram showing a rivet screw 1 according to the present invention.

Referring to FIG. 4, the rivet screw 1 comprises a screw part 11 and a base part 12.

Referring to again FIGS. 1, 2 and 3, the screw part 11 is contained in the bracket 3 and the connector 5. More specifically, the bracket 3 has a hole where the connector is to be installed, and the connector 5 also has a hole corresponding to that hole. The screw part 11 of the rivet screw 1 is inserted, from the bracket 3 side, where the hole of the bracket 3 and the hole of the connector 5 are in alignment.

Returning to FIG. 4, the screw part 11 has the shape of a column. The rivet screw 1 has a hole 111. The hole 111 runs through the screw part 11 and the base part 12. The hole 111 has threads on its inside wall. The base part 12 has the shape of a plate. Both major faces of the base part 12 are quadrilateral. This quadrilateral may be square or rectangular. In short, base part 12 has the shape of the plate whose both major surfaces are quadrilateral.

Referring to FIGS. 1, 2 and 3, the hexagon head screw 2 is engaged with the screw part 11 of the rivet screw 1 through the hole 111. The bracket 3, which is built in the cabinet of a data processing unit, has the same ground potential as that of the cabinet. The bracket 3 is made of metal. The bracket 3 has a rotation prevention element that prevents the rivet screw 1 from turning as the hexagon head screw 2 turns. This prevention element, engaged with the base part 12 of the rivet screw 1, prevents the rivet screw 1 from turning. In this embodiment, the prevention element is projections 31 and 32. When the hexagon head screw 2 turns and then the rivet screw 1 turns, one side, one edge or one vertex of the base part 12 of the rivet screw 1 comes in contact with the projection 31 to prevent the rivet screw 1 from turning.

Figure 5:
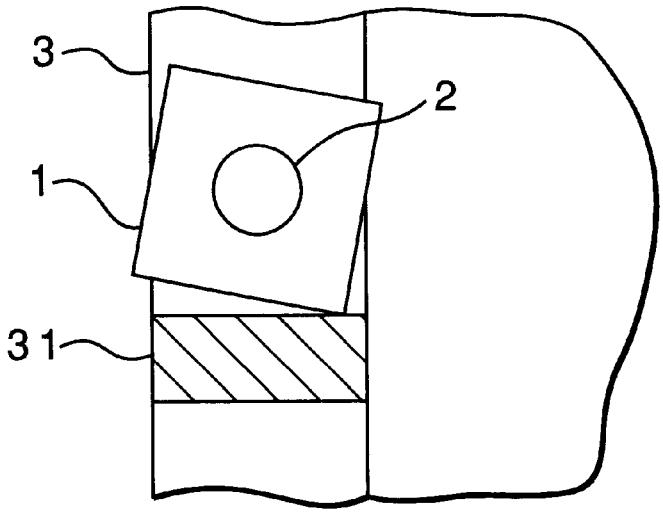
FIG. 5 is a diagram showing a prevention element in the electronic component installation structure according to the present invention.

Referring to FIG. 5, one vertex or one edge of the base part 12 of the rivet screw 1 is in contact with the projection 31.

A lead wire is provided inside the plastic mold 4. The plastic mold 4, made of plastic, protects the internal lead wire.

Next, the operation of the embodiment will be described.

Referring to FIG. 2, the operator turns the hexagon head screw 2 to screw the hexagon head screw 2 into the rivet screw 1. When the hexagon head screw 2 turns as the operator applies torque, the friction between the screw part of the hexagon head screw 2 and the thread on the rivet screw 1 causes the torque to be transmitted from the hexagon head screw 2 to the rivet screw 1. When torque is applied to the rivet screw 1 even after the hexagon head screw 2 is fully engaged with the rivet screw 1 or when the friction between the rivet screw 1 and bracket 3 or the connector 5 is small, the rivet screw 1 is going to turn with the screw part 11 as the rotation axis. That is, whether or not the rivet screw 1 turns depends on the relation between the torque transmitted from the hexagon head screw 2 to the rivet screw 1 and the friction between the rivet screw 1 and the bracket 3 or the connector 5.

Referring to FIG. 5, when the rivet screw 1 starts turning, one vertex, one edge or one side of the base part 12 comes in contact with the projection 31 to prevent the rivet screw 1 from turning. This informs the operator of the fact that the hexagon head screw 2 has been fully engaged with the rivet screw 1 if they are fully engaged.

As described above, even if the torque applied to the hexagon head screw 2 is transmitted to the rivet screw 1 and that torque is going to turn the rivet screw 1, the prevention element in the structure according to present invention prevents the rivet screw 1 from turning. The base part 12 of the rivet screw 1 in the structure according to the present invention is sometimes enclosed in the cabinet of a data processing unit. On the other hand, the hexagon head screw 2 is exposed on the cabinet of the data processing unit. The structure according to the present invention allows the hexagon head screw 2 to be fully engaged with the rivet screw 1 even if the base part 12 of the rivet screw 1 is enclosed in the cabinet.

In addition, even if the torque transmitted from the hexagon head screw 2 to the rivet screw 1 starts turning the rivet screw 1 although the hexagon head screw 2 is not fully engaged with the rivet screw 1, the prevention element according to the present invention prevents the rivet screw 1 from turning. As a result, the operator can keep on turning the hexagon head screw 2 to engage the hexagon head screw 2 with the rivet screw 1. This condition occurs when the torque transmitted from the hexagon head screw 2 to the rivet screw 1 is larger than the friction between the rivet screw 1 and the bracket 3.

In the embodiment described above, the rivet screw 1, hexagon head screw 2, and projection 31 are described. The same structure also applies to the rivet screw 1', hexagon head screw 2', and projection 32.

Although the hole 111 runs through the rivet screw 1 in the above embodiment, a hole that does not run through the rivet screw 1 may also be used. In this case, the hole is provided on the side opposite to the side on which the base part 12 of the rivet screw 1 is provided. In the above embodiment, the screw part 11 and the base part 12 of the rivet screw 1 may be integrated or separated. When separate, the screw part 11 and the base part 12 are connected with an adhesive and so on.

Next, a second embodiment of the present invention will be described in detail. The second embodiment of the present invention is different from the first embodiment in that the prevention element is separate from the bracket 3.

Figure 6:
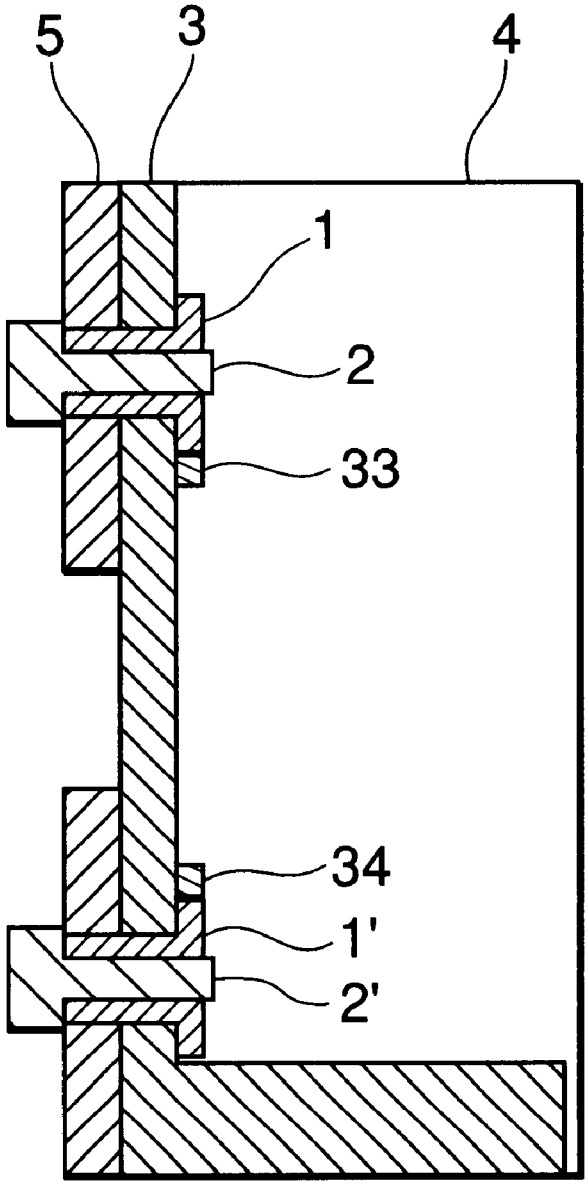
FIG. 6 is a sectional view of an electronic component installation structure in a second embodiment according to the present invention.
Figure 7:
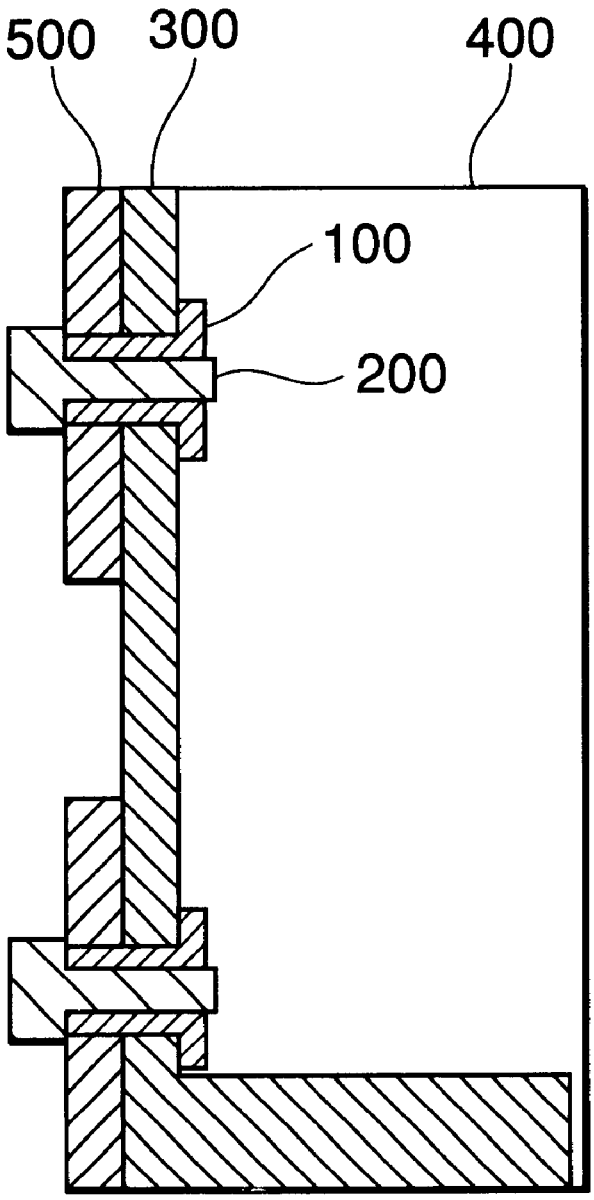
FIG. 7 is a sectional view of a conventional electronic component installation structure.

Referring to FIG. 6, an electronic component installation structure in the second embodiment of the present invention comprises prevention members 33 and 34. The other configuration is similar to that of the first embodiment.

The prevention member 33 is provided in a position adjacent to the rivet screw 1. The prevention member 33 is connected to the bracket 3 with an adhesive and so on. As the rivet screw 1 turns, one of the vertexes, edges or sides of the base part 12 comes in contact with the prevention member 33 and, therefore, the prevention member 33 prevents the rivet screw 1 from turning.

The prevention member 34 is similar in configuration to the prevention member 33.

As described above, the electronic component installation structure according to the present invention prevents a rivet screw from turning by the torque applied to a hexagon head screw. This is because a prevention element is provided to prevent the rivet screw from turning.

In addition, even when the torque applied to the hexagon head screw is transmitted to the rivet screw and going to turn it, the prevention element prevents the rivet screw from turning. This structure gives the operator a feeling that the hexagon head screw has been tightened or allows the operator to realize that the hexagon head screw is fully engaged with the rivet screw.

While this invention has been described in conjunction with the preferred embodiments described above, it will now be possible for those skilled in the art to put this invention into practice in various other manners.

What is claimed is:

1. An electronic component installation structure comprising:

a bracket;

a female screw with a part thereof built in said bracket;

a male screw to be engaged with said female screw; and a projection which is provided on said bracket and prevents said female screw from turning when said male screw turns.

2. The electronic component installation structure as claimed in claim 1, wherein said female screw is a rivet screw.

3. The electronic component installation structure as claimed in claim 3, wherein, when said male screw turns and said female screw starts moving, one of sides, one of edges or one of vertexes of said second part comes in contact with said projection to prevent said female screw from turning.

4. The electronic component installation structure as claimed in claim 3, wherein said second part has a shape of a plate.

5. The electronic component installation structure as claimed in claim 3, wherein said first part and said second part are integrated.

6. The electronic component installation structure as claimed in claim 3, further comprising:

a connection member which connects said first part and said second part.

7. The electronic component installation structure as claimed in claim 1, wherein said projection is integrated in said bracket.

8. The electronic component installation structure as claimed in claim 1, wherein said projection is separate from said bracket.

* * * * *

UNITED STATES PATENT AND TRADEMARK OFFICE

CERTIFICATE OF CORRECTION

PATENT NO. : 6,533,608 B2
DATED : March 18, 2003
INVENTOR(S) : Rikio Sakamoto

It is certified that error appears in the above-identified patent and that said Letters Patent is hereby corrected as shown below:

Column 4,
Line 40, delete “turns.” insert -- turns, wherein:
said female screw comprises a first part and a second part;
said first part is built in said bracket;
said second part is engaged with said projection; and
said first part has a shape of a column and, when said male screw turns, said female screw turns with said first part as a rotation axis. --
Line 63, delete “separate from” insert -- connected to --

Signed and Sealed this

Second Day of September, 2003

JAMES E. ROGAN
*Director of the United States Patent and Trademark Office*